United States Patent [19]

Petit et al.

[11] 4,238,301

[45] Dec. 9, 1980

[54] PROCESS FOR SELECTIVE ELECTROCHEMICAL DIMERIZATION OF CONJUGATED DIENES TO FORM VINYLCYCLOHEXENES

[75] Inventors: Francis Petit, Wasquehal; Dominique Huchette, Vendin-le-Vieil, both of France

[73] Assignee: CdF Chimie, Paris, France

[21] Appl. No.: 37,549

[22] Filed: May 9, 1979

[30] Foreign Application Priority Data

May 9, 1978 [FR] France ..... 78 13697
Nov. 30, 1978 [FR] France ..... 78 33880

[51] Int. Cl.[3] ..... C26B 3/10
[52] U.S. Cl. ..... 204/59 R; 204/72
[58] Field of Search ..... 204/59 R, 72

[56] References Cited

U.S. PATENT DOCUMENTS

| | | | |
|---|---|---|---|
| 3,377,397 | 4/1968 | Maxfield | 585/369 |
| 3,655,793 | 4/1972 | Myers | 260/666 B |
| 3,677,915 | 7/1972 | Schaefer | 204/59 R |
| 3,767,593 | 10/1973 | Myers | 252/429 A |
| 3,773,632 | 11/1973 | Lemkuhl | 204/59 QM |
| 3,954,665 | 5/1976 | Tkatchenko | 252/429 R |

*Primary Examiner*—F. C. Edmundson
*Attorney, Agent, or Firm*—Millen & White

[57] ABSTRACT

A process is provided for the selective electrochemical dimerization of conjugated dienes to form vinylcyclohexenes with a selectivity of up to 100%. An electrochemical catalytic system is provided for effecting the reaction.

30 Claims, No Drawings

PROCESS FOR SELECTIVE ELECTROCHEMICAL DIMERIZATION OF CONJUGATED DIENES TO FORM VINYLCYCLOHEXENES

BACKGROUND OF THE INVENTION

The present invention relates to a process for the selective electrochemical dimerization of conjugated dienes to give substantially exclusively dimers having a cyclohexene structure. The invention also relates to an electrochemical catalytic system whereby this dimerization may be effected. According to the process of the invention, 1,3-butadiene produces only 4-vinylcyclohexane, and isoprene gives a mixture of substituted cyclohexenes containing limonenes (methylisopropenylcyclohexenes) and dimethylvinylcyclohexenes.

Selective chemical dimerizations of conjugated diolefins are known, using catalysts or catalytic systems based, for example, on dinitrosyliron chloride. Thus, French Pat. No. 1,502,141 teaches the use of a catalyst consisting of a dinitrosyliron halide, a reducing agent such as an organomagnesium or organoaluminum compound, and a third component such as arsine, stibine, phosphine, ether, sulfide, or amine derivative. U.S. Pat. Nos. 3,655,793 and 3,767,593 disclose a catalyst couple comprising dinitrosyliron halide and an organoaluminum, borohydride or aluminum hydride reducing agent. French Pat. No. 2,225,401 discloses the use of a catalytic couple comprising dinitrosyliron halide and a metal carbonyl.

It is also known, as disclosed in French Pat. No. 2,080,556, that butadiene can be trimerized to 1,5,9-cyclododecatriene or dimerized to 1,5-cyclooctadiene and/or a linear dimer by an electrochemical process, by forming transition metal complexes in situ and operating at a constant voltage and current of electrolysis. There is no teaching in the prior art of conditions under which butadiene could be selectively dimerized in an electrochemical process to form 4-vinylcyclohexene, much less conditions under which such electrochemical dimerizations might be effected with up to 100% selectivity.

A need therefore continues to exist for an electrochemical process for dimerization of conjugated dienes whereby it would be unnecessary to handle compounds which are for the most part toxic, a process which requires very little energy and which produces selectively the desired dimer having a cyclohexene structure.

OBJECTS OF THE INVENTION

Accordingly, one object of the present invention is to provide a process for selective electrochemical dimerization of conjugated dienes to form cyclohexene-type dimers with substantially 100% selectivity.

Another object of the invention is to provide a catalytic electrochemical system whereby the selective electrochemical dimerization of conjugated dienes to cyclohexene-type dimers may be effected.

Upon further study of the specification and appended claims, further objects and advantages of this invention will become apparent to those skilled in the art.

SUMMARY OF THE INVENTION

Briefly, these and other objects of the invention may be achieved by an electrochemical process for selectively dimerizing conjugated dienes to form vinylcyclohexenes, which comprises the step of reacting a conjugated diene, in the presence of a catalytic quantity of a catalyst selected from dinitrosyliron chloride and iron chloride/nitric oxide; said reaction being effected in the substantial absence of oxygen in an electrolysis cell having an anode, a cathode and a reference electrode; wherein a substantially constant cathode potential with respect to said reference electrode, substantially corresponding to the plateau of the last reduction wave of said catalyst, is maintained during the course of the electrolysis.

DETAILED DISCUSSION

The process of the invention is effected by electrolysis of a conjugated diene in an electrochemical cell in the presence of dinitrosyliron chloride in very low quantities or in the presence of iron chloride and nitric oxide, also in very small quantities. The potential between the cathode and the reference electrode in the cell may be determined in a manner described in detail below. Advantageously, the potential is maintained at a constant level with the aid of a potentiostat which automatically regulates the voltage and the current between the anode and the cathode.

The reaction is effected in the presence of a suitable solvent and preferably in the presence of an electrolyte, which makes it possible to operate with a lower initial voltage between the anode and the cathode.

If a concentrated solution of diene is used, the reaction mixture separates into two phases, the upper phase containing essentially only the desired dimer.

It is possible to obtain dimers having a cyclohexene-structure from conjugated dienes with a selectivity of up to 100% by the use of the process of the invention. Suitable dienes include acyclic dienes having the formula $$R_1R_2C{=}CR_3{-}CR_4{=}CR_5R_6$$

wherein $R_1$–$R_6$ are hydrogen or lower alkyl. Preferred dienes include 1,3-butadiene, isoprene and piperylene. The dienes may be purified products or may be constituents of a particular fraction derived from petrochemical refining. For example, 1,3-butadiene may be supplied as a "$C_4$-cut" from steam cracking of naphtha. This $C_4$-cut may be subjected, as is, to dimerization according to the process of the invention. Of course, only the butadiene will be dimerized, while the other constituents will remain unreacted, and these unreacted constituents may be separated at the end of the reaction from the vinylcyclohexene dimerization product, for example by distillation.

The type of electrochemical cell preferred for use in the process of the invention comprises three electrodes; a cathode, an anode and a reference electrode. The cathode is made of a material which is inert to the reaction medium. The cathode is advantageously made of platinum and a preferred form of the cathode is a platinum wire mesh. The cathode may also be made of vitreous carbon or of iron. The anode should be made of an oxidizable metal. It is preferable to use aluminum when dinitrosyliron chloride is used, and to use iron when a mixture of iron chloride and nitric oxide is used. According to a particularly preferred embodiment of the invention, the anode is a hollow cylinder made of aluminum or iron and the cathode is a cylindrical platinum wire mesh which is exterior to and concentric to the anode. It has been found to be impracticable to separate the anode and cathode in separate compartments.

The reference electrode may be selected from among conventional such electrodes known in the art, such as Ag/AgCl, Ag/Ag+, $Hg/Hg_2Cl_2$ (calomel). It is preferable to locate the reference electrode in the vicinity of the cathode.

The electrochemical solvent used in the process of the invention must be inert to both the reactants and to the reaction conditions. The solvent preferably has a fairly high dielectric constant. A particularly preferred solvent is propylene carbonate. Other suitable solvents include, but are not limited to, ethylene carbonate, tetrahydrofuran.

The diene need not be completely dissolved in the solvent at the start of the reaction.

If an electrolyte is used, it must be soluble in the solvent used for the reaction. Suitable such electrolytes include lithium salts or quaternary ammonium salts, such as LiCl, $LiClO_4$, or quaternary alkyl/aryl ammonium chlorides or perchlorates. Tetrabutylammonium perchlorate is particularly preferred. It is preferable, in order to minimize the junction potential, to add to the reference electrode the same electrolyte as that which is dissolved in the reaction medium, and at the same concentration (except for the case of a calomel electrode, which is used as it is).

It has been found that equally high yields may be obtained when the reaction medium does not contain an electrolyte, with or without the addition of electrolyte to the junction liquid of the reference electrode (again, electrolyte is not added to a calomel electrode).

The dinitrosyliron chloride used in the present process may be prepared by conventional means, in particular according to the following reaction:

$$\mathrm{Fe} + \mathrm{FeCl_2(anhydrous)} + 6\mathrm{NO} \longrightarrow 2\mathrm{Fe(NO)_3Cl} \xrightarrow{\text{sublimation}} [\mathrm{Fe(NO)_2Cl}]_2 + 2\mathrm{NO}$$

Alternatively, the compound may be prepared by the reaction of nitric oxide (NO) on a mixture of iron and $FeCl_3$ in tetrahydrofuran. If desired, the product obtained may be further purified by a second sublimation.

The iron chloride used is either ferrous chloride, $FeCl_2$, or ferric chloride, $FeCl_3$. If needed, the salts may be dried before use. Nitric oxide, NO, is preferably used in the gaseous state, and is advantageously the commercially available liquified bottled gas. It has been found preferable to effect the reaction with a ratio number of moles of NO/number of gram-atoms of Fe between 2 and 12, the yields being optimal in this case.

Furthermore, the reaction will not be successful under just any condition of voltage and current in the electrolysis. Thus, the comparative examples below will show that under conditions which are outside those recited for the process of the invention, an attempt to dimerize isoprene to cyclohexene type structures with a selectivity of up to 100% gives a yield of only 3% after five hours. It is evident that the electrochemical dimerization of the invention must be effected at a controlled potential to produce high yields. A measurement using a conventional apparatus of a voltage-amperage curve of the mixture of solvent and either $Fe(NO)_2Cl$ or $FeCl_2$/NO, with or without an electrolyte, shows that there are two reduction waves. An analogous measurement for the system of solvent and $FeCl_3$/NO, either with or without an electrolyte, shows that there are three reduction waves in this case. It has further been found that the process according to the invention should be effected while maintaining the cathode potential essentially constant with respect to the reference electrode, at a value of about the plateau of the last reduction wave, regardless of which reference electrode is used, it being understood that the electrode used in the process of the invention is of the same type as that which was used to measure the reduction curve.

Thus, using $Fe(NO)_2Cl$ together with Ag/AgCl reference electrode, the cathode potential relative to the reference electrode should be from −100 to −400 mV; with a Ag/Ag+ reference electrode, the cathode potential should be from −1500 to −1800 mV; and with a calomel reference electrode, the cathode potential with respect to the reference should be from −700 to −1000 mV.

When ferric chloride and nitric oxide are used, with a Ag/AgCl reference electrode, the cathode potential relative to the reference electrode should be between −600 to −1600 mV.

It is advantageous to use a potentiostat to maintain a constant cathode potential relative to the reference electrode, in a manner well known to the art. The potentiostat provides a working voltage and current between the anode and cathode which are functions of the chosen reference potential and the characteristics of the reaction medium, such as the dielectric constant of the solvent and the resistivity of the reaction mixture.

Thus, at the start of the reaction, after a reference potential has been selected, the potentiostat generates a current between the anode and cathode which has been found to be a function of the concentration of iron compound in the medium. When dinitrosyliron chloride is used, the starting current is between 40 and 100 milliamperes for concentrations of $Fe(NO)_2Cl$ between 5 and 40 millimoles per liter, under a voltage which is found to be an inverse function of the concentration of the electrolyte and in the neighborhood of 2 to 5 volts for concentrations of tetrabutylammonium perchlorate of about 0.16 to 0.12 mole per liter of the reaction mixture. These voltage and current values correspond to a separation between the anode and the cathode of about 1 cm.

It is evident that the concentration of electrolyte may be reduced if desired. The voltage between anode and cathode will then have a higher value than that indicated above. In the absence of electrolyte, the starting voltage between the anode and the cathode will be about 20 to 35 volts. By the same token, the concentration of $Fe(NO)_2Cl$ may also be reduced, which will result in a reduction in the value of the initial current. It is preferable to use a concentration of $Fe(NO)_2Cl$ such that the starting current is from 40 to 150 mA.

It is also possible, if desired, to change the distance between the anode and the cathode.

In any case, the working current and voltage levels will diminish as a function of time to reach values of several hundred microamps and several millivolts, respectively, after several hours, in the case where an electrolyte is present, and levels of several milliamperes and several volts in the absence of electrolyte, the reference potential always being at the level chosen at the start of the reaction.

The process is preferably effected at ambient temperature and at a pressure corresponding to the vapor pressure of the reaction medium at the particular reaction temperature chosen. The pressure generally does not exceed one bar.

It is essential to effect the reaction in the substantial absence of oxygen, preferably in the absence of a measurable amount thereof.

Finally, the reaction medium should be continually agitated so that diffusion phenomena are accelerated. Agitation may be effected mechanically, in a conventional manner. It is also possible to continually replace the layer of liquid in contact with the working electrodes by using a rotating anode and/or cathode.

EXAMPLES

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever. In the following examples, all temperatures are set forth uncorrected in degrees Celsius, and unless otherwise indicated, all parts and percentages are by weight.

In the following examples, the process is effected in a glass electrochemical cell capable of working under a maximum pressure of 1 bar and comprising conduits for adding and withdrawing materials, magnetic stirring means, a hollow cylindrical anode having a diameter of about 2 cm. and a height of about 6 cm., a cathode concentric to the anode of the same height and of a diameter of about 4 cm., and a reference electrode situated as close as possible to the cathode. Oxygen is excluded from the system.

When butadiene is reacted, the starting material is cooled to −10° C. before it is introduced into the electrochemical cell. The temperature of the reaction medium is then allowed to rise to ambient temperature, about 20° C.

EXAMPLES 1-10:

Use of $Fe(NO)_2Cl$; aluminum anode; platinum mesh cathode.

EXAMPLE 1

In the electrochemical cell, with Ag/AgCl reference electrode, are placed:

100 ml propylene carbonate,
6.8 g (0.02 mole) tetrabutylammonium perchlorate,
24.5 g (0.45 mole) 1,3-butadiene,
130 mg (0.86 millimole) dinitrosyliron chloride as $Fe(NO)_2Cl$.

Using a potentiostat, a cathode potential of −100 mV with respect to the reference electrode is applied. The potentiostat automatically generates a voltage of 4 volts and a current of 40 mA between the anode and the cathode. After 20 minutes, these values become 2 volts and 25 mA, and after three hours, several tenths of a volt and 1 mA.

After three hours, 85% of the starting butadiene has been selectively converted to 4-vinylcyclohexene, by chromatographic analysis.

EXAMPLE 2

In the electrochemical cell, with Ag/Ag+ reference electrode, are placed:

100 ml propylene carbonate,
6.8 g (0.02 mole) tetrabutylammonium perchlorate,
54 g (1 mole) 1,3-butadiene,
102 mg (0.67 millimole) $Fe(NO)_2Cl$.

With the aid of a potentiostat, a cathode potential with respect to the reference electrode of −1500 millivolts is applied. The potentiostat automatically keeps this potential constant during the entire course of the reaction. At the start, the working voltage is 2 volts and the current is 40 mA. The reaction is stopped at the end of 5 hours. The reaction mixture forms two phases. Chromatographic analysis of the upper phase shows that it contains 17.3% by weight butadiene and 82.7% by weight vinylcyclohexene.

The lower phase contains besides propylene carbonate and electrolyte: 5.5% by weight butadiene and 5.7% by weight vinylcyclohexene. The conversion yield of butadiene to vinylcyclohexene is 75%. The reactor is cooled to −10°, the upper phase is withdrawn, the butadiene is distilled off and the vinylcyclohexene is purified by redistillation. A final product of 36 grams of chromatographically pure 4-vinylcyclohexene is thereby obtained.

EXAMPLE 3

In the electrochemical cell, using a calomel reference electrode, are placed:

110 ml of a 0.2 molar solution of tetrabutyl-ammonium perchlorate in propylene carbonate,
20 g of a "C4 cut" fraction from the steam cracking of naphtha, containing 50% by weight of 1,3-butadiene (the other constituents are 2-methylpropene, 1-butene, cis and trans-2-butenes and butane),
273 mg (1.8 millimoles) $Fe(NO)_2Cl$.

With the aid of a potentiostat, a cathode potential with respect to the reference electrode of −750 millivolts is applied. At time 0, the potentiostat automatically generates a voltage of 2 volts between the anode and the cathode and a current of 80 mA.

After five hours of reaction, the voltage becomes negligible (the cathode potential relative to the reference electrode being always equal to −750 mV) and the current is about 2 mA.

Chromatographic analysis of the reaction medium shows that it contains 5.5 grams of vinylcyclohexene and that no other product forms.

In this case, the selective dimerization of 1,3-butadiene is effected with a conversion yield for 1,3-butadiene of 55%. The other constituents of the "C4 cut" are unchanged.

EXAMPLE 4

In the electrochemical cell, using a Ag/AgCl reference electrode, are placed:

110 ml of a 0.2 molar solution of tetrabutylammonium perchlorate in propylene carbonate,
44.4 g (0.653 mole) isoprene,
485 mg (3.2 millimoles) $Fe(NO)_2Cl$.

With the aid of a potentiostat, a cathode potential with respect to the reference electrode of −100 mV is applied. The potentiostat initially generates a current between the anode and the cathode of about 100 mA and a voltage of about 5 volts.

The reaction is stopped at the end of 5 hours. The reaction medium has separated into two phases. Chromatographic analysis of these two phases shows that isoprene is selectively converted to dimers having a cyclohexene-type structure, in a conversion yield of 50%. The product contains 88% of the two dimethylvinylcyclohexenes and 12% of the two limonenes.

The upper phase contains 15% isoprene and 85% of the dimers, which can be purified by distillation and rectification.

EXAMPLE 5

Example 4 is repeated using 33.3 grams (0.49 mole) of isoprene. The initial working voltage is 3 volts and the initial current is 70 mA.

After 20 hours, the conversion yield of isoprene into dimers having a cyclohexene-type structure is 67%.

EXAMPLE 6 (Comparative Example)

Example 4 is repeated, except that a cathode potential with respect to the Ag/AgCl reference electrode of +200 mV is applied. This value corresponds to the first reduction wave determined voltamperometrically on a mixture of propylene carbonate plus tetrabutylammonium perchlorate plus $Fe(NO)_2Cl$ (Ag/AgCl reference electrode).

At the end of 5 hours of reaction, the conversion yield of isoprene to dimers is only 3%.

EXAMPLE 7

In the electrochemical cell, using a Ag/AgCl reference electrode whose junction liquid contains 0.2 moles per liter of tetrabutylammonium perchlorate, is placed:
100 ml propylene carbonate,
20.4 g (0.3 mole) isoprene,
197 mg (1.3 millimole) $Fe(NO)_2Cl$.

With the aid of a potentiostat, a cathode potential with respect to the reference electrode of −100 mV is applied. The potentiostat generates an initial voltage and current of 35 volts and 90 mA. At the end of one hour and 30 minutes, the appearance of a second liquid phase is observed. The reaction is stopped at the end of 3 hours and the conversion yield of isoprene to dimers having a cyclohexene-type structure is 99%.

EXAMPLE 8

Example 7 is repeated without introducing tetrabutylammonium perchlorate in the reference electrode and using 144.7 mg (0.96 millimole) of $Fe(NO)_2Cl$.

Initially, the voltage and current between the anode and cathode are 30 volts and 68 mA, respectively.

After 3 hours of reaction, the conversion yield of isoprene is 97%.

EXAMPLE 9

In the electrochemical cell, using a Ag/AgCl reference electrode which does not contain tetrabutylammonium perchlorate, are placed:
70 ml propylene carbonate,
40.8 g (0.6 mole) isoprene,
341 mg (2.25 millimoles) $Fe(NO)_2Cl$.

The mixture is heterogeneous from the beginning.

After a cathode potential with respect to the reference electrode of −100 mV has been applied, the potentiostat generates an initial current between the anode and the cathode of 135 mA at an initial voltage of 34 volts.

The reaction is stopped after 15 hours, after which the conversion yield of isoprene is 99%.

EXAMPLE 10

In the electrochemical cell, with a Ag/AgCl reference electrode which does not contain tetrabutylammonium perchlorate, are placed:
80 ml propylene carbonate,
59 g (1.09 mole) 1,3-butadiene,
100 mg (0.66 millimole) $Fe(NO)_2Cl$.

With the aid of a potentiostat, a cathode potential with respect to the reference electrode of −100 mV is applied. The potentiostat automatically generates an initial current between the anode and cathode of 44 mA and a voltage of 20 volts.

After one hour and 30 minutes the appearance of a second liquid phase is observed. The reaction is stopped after 3 hours and the two liquid phases are separated. The upper phase contains 92% by weight of 4-vinylcyclohexene and 8% by weight of butadiene. The lower phase contains, besides propylene carbonate, 12% by weight of 4-vinylcyclohexene and 3% by weight of butadiene.

The conversion yield of 1,3-butadiene to 4-vinylcyclohexene is 90%.

The selectivity of this conversion is 100%, as in all the other examples.

EXAMPLES 11–22

The conditions and results of these examples are shown in the following table. A mixture of ferric chloride ($FeCl_3$) and nitric oxide (NO) was used, together with a Ag/AgCl reference electrode. A constant cathode potential with respect to the reference electrode of −700 mV was maintained with the use of a potentiostat, which produced a working current and working voltage between the anode and the cathode whose values are shown in the table. The final current is also shown in the table.

In all the reactions of the following examples, a solution of $FeCl_3$ in propylene carbonate is prepared in advance. The solution is placed in the electrochemical cell, the diene or the petroleum fraction containing the diene is added, and the electrolyte, if any, is also added. The medium is purged with nitrogen, after which nitric oxide is added and the potentiostat is set. The reactions are all effected at ambient temperature.

The reaction is stopped at the end of a period of time given in the table, after which the conversion yield to dimer is determined. The selectivity is always 100%, indicating that even higher conversion yields can be obtained by prolonging the reaction time.

The preceding examples can be repeated with similar success by substituting generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

TABLE

| Example | P.C. ml | TBAP mole | $FeCl_3$ mg (m.mole) | Diene type; moles | NO m.mole | Anode | Cathode | Init. Cur. mA | Init. Volt. V | Reaction Time h | Final Cur. mA | Conv. Yield to dimer % |
|---|---|---|---|---|---|---|---|---|---|---|---|---|
| 11 | 90 | $9 \times 10^{-4}$ | 164.3 (1.01) | Isoprene; 0.3 | 2.02 | Al | Pt (mesh) | 250 | 25 | 3 | 25 | 9 |
| 12 | 90 | $9 \times 10^{-4}$ | 81 (0.5) | " | 3 | Fe (plate) | " | 140 | 15 | 3 | 5 | 58 |
| 13 | 90 | 0 | 84 (0.52) | " | 3.12 | " | " | 80 | 14 | 3 | 10.6 | 50 |
| 14 | 90 | 0 | " | " | " | " | Fe (gauze) | 60 | 15 | 3 | 10.5 | 45 |
| 15 | 90 | 0 | 86 (0.53) | " | 3.18 | Fe (gauze) | Pt (mesh) | 72.5 | 15 | 3 | 12.5 | 55 |
| 16 | 80 | 0 | 87 (0.537) | Isoprene; 0.7 | 3.2 | " | " | 40 | 7 | 3.3 | 20 | 70 |
| 17 | 90 | 0 | 88 (0.54) | Isoprene; 0.3 | 3 | Al | " | 80 | 15 | 3 | 15 | 40 |
| 18 | 90 | 0 | " | " | 1.08 | " | " | 130 | 30 | 3 | 7 | 26 |
| 19 | 90 | 0 | " | 1,3-Butadiene; 0.326 | 3.24 | Fe (gauze) | " | 32 | 10 | 3 | 15 | 97 |
| 20 | 90 | 0 | 86 (0.53) | 1,3-Butadiene; 0.945 | 3 | " | " | 40 | 11 | 3 | 18 | 75 |
| 21 | 90 | 0 | " | C4:27 g (0.23 mole of butadiene) | 3.2 | " | " | 40 | 11 | 3 | 17 | 62 |
| 22 | 90 | 0 | " | C4:56.6 g (0.33 mole of butadiene) | 3 | " | " | 40 | 10 | 3 | 19 | 90 |

Abbreviations:
P.C. = Propylene carbonate
TBAP = Tetrabutylammonium perchlorate
Init. Cur. = Initial Current
Init. Volt. = Initial voltage
Final Cur. = Final Current
Conv. Yield = Conversion yield

We claim:

1. An electrochemical process for selectively dimerizing conjugated dienes to form vinylcyclohexenes, which comprises the step of reacting a conjugated diene, in the presence of a catalytic quantity of a catalyst selected from dinitrosyliron chloride and iron chloride/nitric oxide; said reaction being effected in the substantial absence of oxygen in an electrolysis cell having an anode, a cathode and a reference electrode, and in the presence of a solvent which is inert to both the reactants and the reaction conditions; wherein a substantially constant cathode potential with respect to said reference electrode, substantially corresponding to the plateau of the last reduction wave of said catalyst, is maintained during the course of the electrolysis.

2. The process of claim 1, wherein said catalyst is iron chloride and nitric oxide.

3. The process of claim 2, wherein the ratio of the number of moles of nitric oxide to the number of gram-atoms of iron, as iron chloride, present in the reaction medium is between 2 and 12.

4. The process of claim 2, wherein the iron chloride used is ferric chloride ($FeCl_3$).

5. The process of claim 2, wherein the iron chloride used is ferrous chloride ($FeCl_2$).

6. The process of claim 2, wherein the reference electrode is a Ag/AgCl electrode, and wherein the applied cathode potential with respect to said reference electrode is between −600 and −1600 mV.

7. The process of claim 1, wherein said catalyst is dinitrosyliron chloride.

8. The process of claim 7, wherein the reference electrode is a Ag/AgCl electrode, and wherein the applied cathode potential with respect to said reference electrode is between −100 and −400 mV.

9. The process of claim 7, wherein the reference electrode is a $Ag/Ag^+$ electrode, and wherein the applied cathode potential with respect to said reference electrode is between −1500 and −1800 mV.

10. The process of claim 7, wherein the reference electrode is a calomel electrode, and wherein the applied cathode potential with respect to said reference electrode is between −700 and −1000 mV.

11. The process of claim 1, wherein said solvent contains a soluble electrolyte.

12. The process of claim 11, wherein said electrolyte is a lithium salt or a quaternary ammonium salt.

13. The process of claim 11, wherein said electrolyte is tetrabutylammonium perchlorate.

14. The process of claim 1, wherein said conjugated diene is 1,3-butadiene.

15. The process of claim 14, wherein said butadiene is contained in a C4-cut from steam cracking of naphtha.

16. The process of claim 1, wherein said conjugated diene has the formula $R_1R_2C{=}CR_3{-}R_4C{=}CR_5R_6$, wherein $R_1$–$R_6$ are each H or lower alkyl.

17. The process of claim 1, wherein said conjugated diene is isoprene.

18. The process of claim 1, wherein said conjugated diene is piperylene.

19. The process of claim 1, wherein said anode comprises an oxidizable metal, said oxidizable metal being aluminum.

20. The process of claim 1, wherein said anode comprises an oxidizable metal, said oxidizable metal being iron.

21. The process of claim 1, wherein said cathode comprises platinum.

22. The process of claim 1, wherein said cathode comprises iron.

23. The process of claim 1, wherein said cathode comprises vitreous carbon.

24. The process of claim 1, wherein said solvent is selected from carbonate esters and tetrahydrofuran.

25. The process of claim 1, wherein said solvent is propylene carbonate.

26. The process of claim 1, wherein said reference electrode is selected from a Ag/AgCl electrode, a $Ag/Ag^+$ electrode and a calomel electrode.

27. The process of claim 1, wherein a potentiostat is used to automatically control the voltage and the current between the anode and the cathode while maintaining the cathode potential constant with respect to the reference electrode.

28. The process of claim 1, wherein the reaction is effected at ambient temperature.

29. The process of claim 1, wherein the reaction is effected at a pressure substantially equal to the vapor pressure of the reaction medium.

30. The process of claim 1, wherein the amounts of solvent and of diene used are such that at the beginning of the reaction, said diene is not completely dissolved in said solvent.

* * * * *